United States Patent [19]

Yasunaga et al.

[11] 4,302,115

[45] Nov. 24, 1981

[54] SYSTEM FOR DRIVING PRINT WIRES FOR PRINTERS

[75] Inventors: Makoto Yasunaga; Toshio Kurihara, both of Tokorozawa, Japan

[73] Assignee: Citizen Watch Co., Ltd., Tokyo, Japan

[21] Appl. No.: 102,433

[22] Filed: Dec. 11, 1979

[30] Foreign Application Priority Data

Dec. 12, 1978 [JP] Japan ..... 53-154320

[51] Int. Cl.[3] ..... B41J 3/12

[52] U.S. Cl. ..... 400/124; 101/93.05

[58] Field of Search ..... 400/124; 101/93.05; 335/82

[56] References Cited

U.S. PATENT DOCUMENTS

| | | | |
|---|---|---|---|
| 3,217,640 | 11/1965 | Bradshaw | 400/124 X |
| 3,333,667 | 8/1967 | Nordin | 400/124 |
| 3,631,366 | 12/1971 | Ugon | 335/82 |
| 3,973,661 | 8/1976 | De Boo et al. | 400/124 |
| 4,127,334 | 11/1978 | Watanabe et al. | 400/124 |

*Primary Examiner*—Paul T. Sewell

*Attorney, Agent, or Firm*—Birch, Stewart, Kolasch and Birch

[57] ABSTRACT

A print wire driver for dot matrix impact printers comprises a pair of yokes made of magnetic material, a solenoid disposed between the yokes, an armature extending through the solenoid, and a print wire connected to the end of the armature. One of the yokes has first and second projected yoke ends, the other has third and fourth yoke ends, which are opposed to each other. The solenoid is disposed between the projected yoke ends. Between the yokes, a permanent magnet is provided to magnetize both yokes in reverse polarity with each other. The armature and four yoke ends are so arranged as to make two magnetic circuits, one of which is the path connecting the first yoke end, armature and fourth yoke end, and the other is the path connecting the second yoke end, armature and third yoke end. The solenoid is excited alternately in polarity to alternately magnetize the armature. Thus, the armature is reciprocated by the attractive and repulsive forces of the magnetic circuit to drive the print wire.

11 Claims, 9 Drawing Figures

SYSTEM FOR DRIVING PRINT WIRES FOR PRINTERS

BACKGROUND OF THE INVENTION

The present invention relates to a system for driving print wires for dot matrix impact printers, such as a serial dot printer and a dot line printer.

As a driving mechanism for the print wire, an electromagnetic means is widely used for driving an armature connected to the print wire. In such a mechanism, since the attractive force of the magnet is inversely proportional to the square of distance, the force exerted on the armature is small in an early period of the stroke of it and increases as it approaches the stroke end. Therefore, the armature, due to its inertia, does not move at a high speed with a rapid response and power consumption of the driving mechanism increases. To resolve such a problem, there has been proposed a mechanism for driving the armature by an energy stored in a spring during the print stroke and for retracting it by the magnet attraction. In such a mechanism, the electromagnet must operate to move the armature against the spring force, which also results in an increase of power consumption.

SUMMARY OF THE INVENTION

An object of the present invention is to provide a system for driving print wires for printers which may decrease the power consumption and has a high degree of responsiveness.

Another object of the present invention is to provide a print wire driving device which is simplified in construction and may be constructed with a small number of parts, and which is small in size and economical.

To this end, the print wire driving device of the present invention comprises a first yoke having first and second yoke ends which are disposed at an interval, a second yoke magnetically engaged with said first yoke, said second yoke having third and forth yoke ends opposite said first and second yoke ends, means for magnetizing said first and second yokes in reverse polarity with each other, solenoids disposed between said first and second yokes, an armature movably provided in each solenoid, said armature extending through the solenoid and having a first end and a second end, and a print wire adjacent an end portion of said first end of the armature, said first, second, third and fourth yoke ends and armature being so arranged as to make two magnetic circuits one of which is the path connecting said first yoke end, armature and fourth yoke end, the other is the path connecting said second yoke end, armature and third yoke end, whereby said armature may be reciprocated by alternate excitation of said solenoid.

These and other objects and features of the present invention will become more fully apparent from the following description with reference to the accompanying drawings.

DESCRIPTION OF THE PREFERRED EMBODIMENTS

Figure 1:
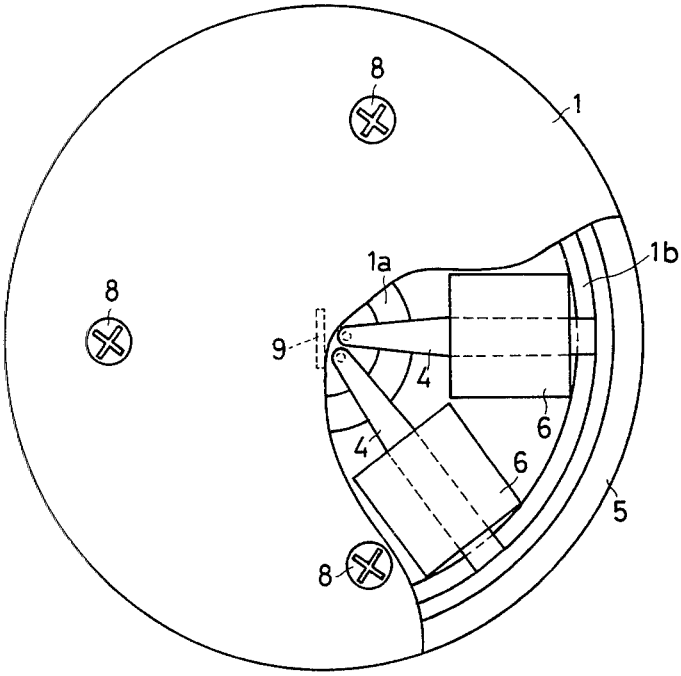
FIG. 1 is a plan view of a print wire driving system of the present invention, a part of which is broken away.
Figure 2:
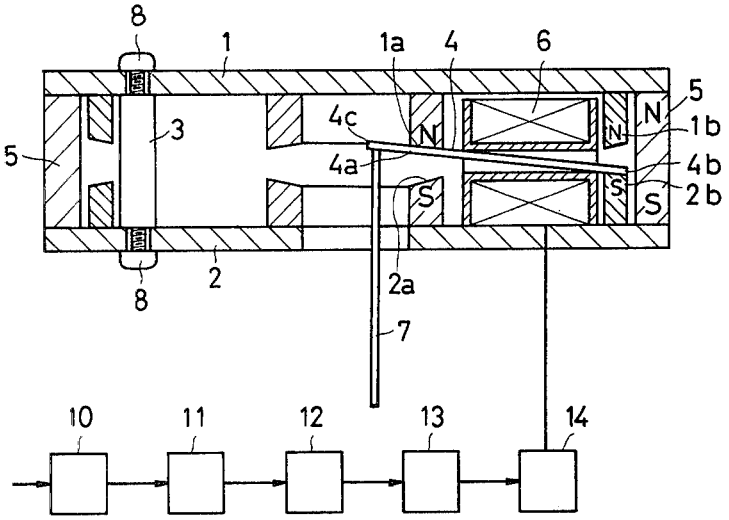
FIG. 2 is a sectional view of the device of FIG. 1.
Figure 3:
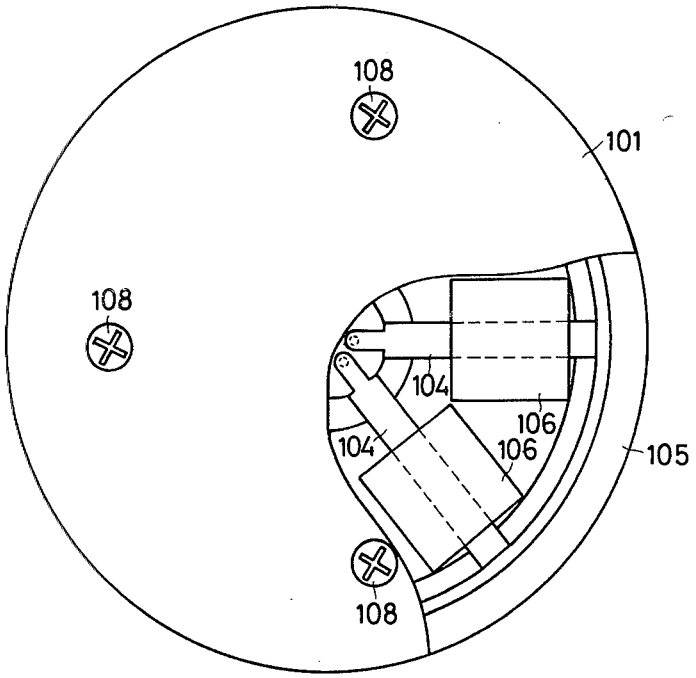
FIG. 3 is a plan view of another embodiment of the present invention, partly broken away.

Referring to FIGS. 1 and 2 showing a print wire driving system of the present invention for a serial dot matrix impact printer, the system comprises a first yoke 1 and a second yoke 2, which are made of material having a high permeability and formed into a disk, respectively. The first yoke 1 has a first yoke end 1*a* formed on an inner circular projection provided on the yoke and has a second yoke end 1*b* formed on an outer circular projection. Similarly, the second yoke 2 has a third yoke end 2*a* and a fourth yoke end 2*b*, which are formed on an inner circular projection and an outer circular projection, respectively. Between the first yoke 1 and the second yoke 2, three posts 3 made of non-magnetic material, a circular permanent magnet 5 and seven pieces of solenoid operated devices 6 are disposed, and both yokes are coupled with each other by screws 8 secured to the posts 3. The first yoke end 1*a* is opposed to the third yoke end 2*a* and the second yoke end 1*b* is opposed to the fourth yoke end 2*b*, and the opposed ends are magnetized in reverse polarity by the permanent magnet 5 as shown in FIG. 2. In the illustrated embodiment, the permanent magnet has the north pole at the end abutted on the first yoke 1 and the south pole at the opposite end abutted on the second yoke 2. Therefore, the first yoke end 1*a* and second yoke end 1*b* are magnetized in the north pole and the third yoke ends 2*a* and fourth yoke end 2*b* are magnetized in the south pole. The solenoid operated devices 6 are radially arranged between the circular yoke projections and secured to the second yoke 2. Each solenoid operated device comprises a solenoid and an armature 4 slidably provided in the solenoid. The armature 4 is made of high permeable material. Each armature has a first end 4*a* extending to a central portion beyond first and third yoke ends 1*a* and 2*a* and has a second end 4*b* extending to second and fourth yoke ends 1*b* and 2*b*. Thus, there may be formed two magnetic circuits, one of which is the patch connecting the permanent magnet 5, first yoke end 1*a*, armature 4 and fourth yoke end 2*b*, and the other is the path connecting the permanent magnet 5, second yoke end 1*b*, armature 4 (attracted to yoke ends 1*b* and 2*a*) and third yoke end 2*a*.

A print wire 7 is secured to the inner end 4*c* of the armature 4 making approximately right angle with it. Each print wire extends along a well known guiding member (not shown) and extends to an end opening 9. The print wires are arrayed straight by a perforated guide plate (not shown) and projected from the end opening 9, as well known.

In this system, each solenoid is alternately excited by a control means in accordance with a print signal. Explaining an example of the control means, the means comprises an interface 10 connected to a computer, a register 11 memorizing the output of the interface 10, a print signal generator 12, a buffer 13 and a solenoid driver 14. The control means is so designed that the solenoid driver 14 operates to excite the solenoid for a predetermined period of time in a polarity and then to excite it again for a predetermined period of time in reverse polarity.

In operation, each solenoid 6 is excited for a predetermined period of time by the control means, so that the armature 4 may be magnetized in such polarity as the second end 4*b* is north pole and the first end 4*a* is south pole. Thus, the armature is attracted to the first yoke end 1*a* and the fourth yoke end 2*b* to take up the starting position as shown in FIG. 2. When the solenoid 6 is excited for a predetermined period of time in the reverse polarity, the first end 4*a* of the armature is magnetized in north pole and the second end 4*b* magnetized in south pole. Thus, repulsive force occurs between the first yoke end 1*a* and the first armature end 4*a* and between the fourth yoke end 2*b* and the second armature end 4*b*, and attractive force occurs between the third yoke end 2*a* and the first armature end 4*a* and between the second yoke end 1*b* and the second armature end 4*b*, so that the armature 4 shown in FIG. 2 is rotated in the counter clockwise direction. As a result, the print wire 7 is moved to impact an inked ribbon (not shown) against a recording paper (not shown) to print a dot on the paper. Thereafter, the solenoid 6 is excited again in the initial polarity for a predetermined period, so that the armature 4 is returned to the waiting position by the repulsive force and attractive force generated in reverse between the yokes and the armature. Thus, the print wire 7 is retracted, and the solenoid is deenergized.

Solenoids 6 are selectively energized in accordance with a signal from the control means and the printing head comprising the print wire driving devices is moved to the lateral direction perpendicular to the array of the print wire 7 passing through the opening 9. Thus, a serial dot matrix print may be made.

In accordance with the present invention, since both the attractive force and the repulsive force exert on the armature and moreover the forces act on the opposite ends of the armature as a couple, the forces may be efficiently used to drive the armature, which produces a great driving force. Thus, the armature may be driven with a small power consumption and with a rapid responce. Further, since the armature is reciprocated by reversing the polarity of the solenoid, a return spring for the armature is not necessary. Therefore, the armature may be driven with a small power consumption. In addition, the number of parts of the mechanism may be decreased, and hence the mechanism may be constructed in small size.

Referring to FIGS. 3 to 7 showing another embodiment of the present invention, the system comprises a first yoke 101, second yoke 102, a permanent magnet 105, posts 103, securing screws 108, and solenoid devices 106, which are disposed similarly to the previous embodiment. An armature 104 of each solenoid operated device 106 is not connected to a print wire 107, but adjacent to it at a small space. The print wire 107 is held at a position by a spring 109 and a stop flange 107*a* of the wire. In this embodiment, the print wire 107 is designed to have a smaller equivalent mass than that of the armature.

Figure 5:
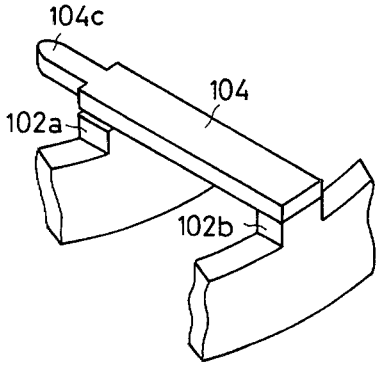
FIG. 5 is a perspective view showing an armature and a part of a yoke in the device of FIG. 3, FIGS. 6 and 7 are perspective views showing other examples of armatures, respectively.

As shown in FIG. 5, the width of the end portion 104*c* of the armature 104 is smaller than that of the armature body portion which abuts on yoke ends 101*a*, 101*b*, 102*a* and 102*b*. Further, the portion of each yoke end adjacent the armature is projected to the armature. According to such a construction of the armature and yoke ends, the armature reciprocates within the area between the projected yoke ends in which the greatest attractive and repulsive forces act on the armature. Thus, the armature is guided by the magnetic force and no mechanical guide means is necessary.

Figure 6:
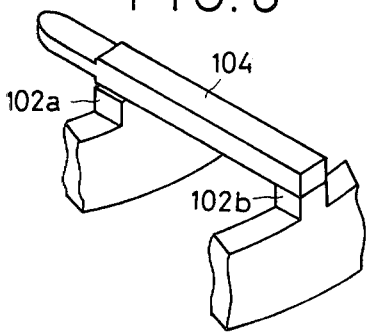
Figure 7:
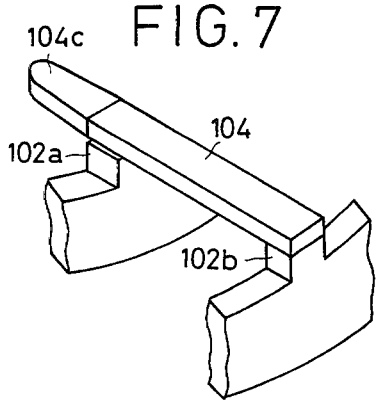

FIG. 6 shows another example of the armature. The sectional area of the armature body portion adjacent the projected yoke ends in this example is greater than that of the armature end portion 104*c*. The example shown in FIG. 7 comprises an armature body portion made of magnetic material and a yoke end portion 104*c* made of non-magnetic material. In this example, the armature may also be guided by the magnetic force.

Figure 4:
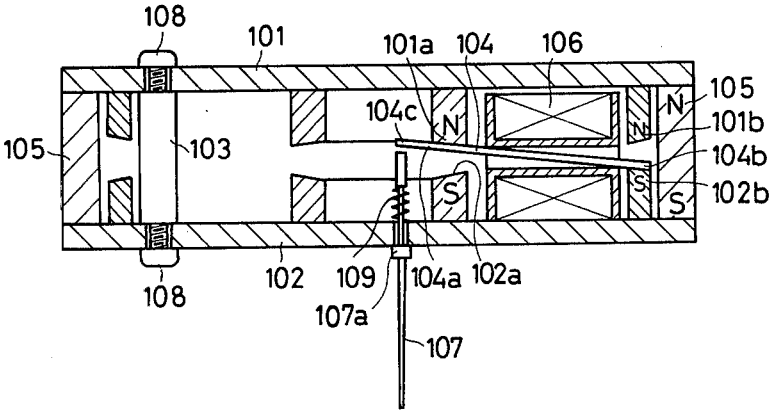
FIG. 4 is a sectional view of the device of FIG. 3.

Operation of this embodiment is similar to the previous embodiment. In the starting position, each solenoid is energized for a predetermined time so as to magnetize the first armature end 104*a* in the south pole, so that the armature 104 is attracted and rested on the yoke ends as shown in FIG. 4. When a selected solenoid is reversely energized for a predetermined time so as to magnetize the first armature end in the north pole, the armature is rotated in the counter clockwise direction (in FIG. 4) by attractive and repulsive forces. The rotating armature end 104*c* strikes the end of the print wire 107, so that the print wire flys downwardly (in FIG. 4) against the force of the spring 109 to make a dot print. Since the equivalent mass of the armature 104 is greater than that of the print wire 107, the moving speed of the print wire is higher than that of the armature. Thus, it is possible to obtain a rapid respose of movement of the print wire.

After the movement of the print wire, the solenoid is excited in the reverse polarity, so that the armature is returned to the waiting position. The print wire is also returned by the spring 109 after the armature has returned. Such an operation is repeated to perform a dot matrix print.

In accordance with this embodiment, since the armature is guided by the magnetic force, it is not necessary to provide a mechanical guide means. Therefore, the print wire driving device is simple in construction and may be made in compact size. Further, since there is no friction in the movement of the armature, a long life time may be expected.

Figure 8:
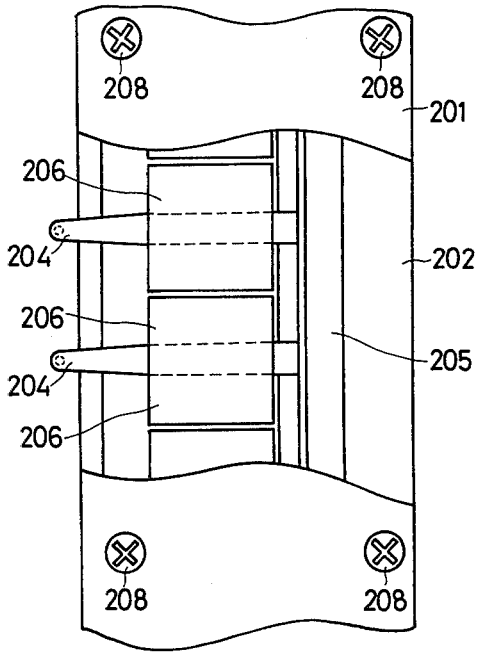
FIG. 8 is a plan view, partly broken away, showing a further embodiment of the present invention.
Figure 9:
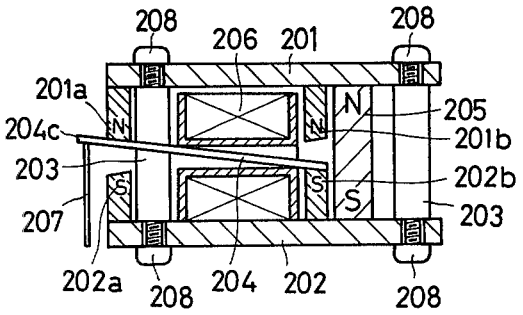
FIG. 9 is a sectional view of the device of FIG. 8.

FIGS. 8 and 9 show an embodiment of the present invention for a dot line printer. Explaining the dot line printer, print wires are arranged on a straight line along the row of the matrix of the character. Each print wire acts to print one or more characters, for example, four characters. In the case of the matrix comprising five columns and seven rows per character and a dot space between characters, the print head having print wire driving devices is stepped six times along the row per one character. In the case that each print wire is allotted for four characters, the print head is stepped $6\times4$ times and then returned to the start position. The recording paper is fed one row pitch and the next row dot print is started. Thus, by printing seven rows of the matrix, printing of one line is completed. In the case of ten print wire driving devices, 40 characters are printed in one line.

Referring to FIGS. 8 and 9, a first yoke 201 and a second yoke 202 are made of rectangular plates having a high permeability, respectively. The first yoke 201 has a first yoke end 201*a* and a second yoke end 201*b* and the second yoke 202 has a third yoke end 202*a* and a fourth yoke end 202*b* opposite the first and second yoke ends. Both yokes 201 and 202 are connected with each other by posts 203 and screws 208 with interposing a permanent magnet 205. Between the yokes, a plurality of solenoid operated devices 206 are provided. Each solenoid operated device comprises a solenoid and an armature 204. A print wire 207 is connected to the end 204c of the armature 204 and guided by a guiding means (not shown).

Operation of each solenoid operated device is the same as the first embodiment shown in FIGS. 1 and 2. The printing head is shifted by a driving means (not shown) in the direction of the print wire array, that is the direction of the row of the matrix. During the movement of the printing head, each solenoid operated device is operated to print dots. After completion of printing of the row, the printing head is returned as described above. Paper (not shown) is then fed to the direction perpendicular to the row and the next row printing is performed. This operation is repeated to make a matrix printing.

It will be seen from the foregoing description that the present invention provides a print wire driving device in which both attractive force and repulsive force are used to drive the armature and both forces act on opposite ends of the armature as a couple, whereby the device may be operated with a small power consumption and with a rapid response. Since the armature is reciprocated by the magnetic force, no return spring is necessary. Thus, the number of parts of the device may be decreased and assembling work of the device may be simplified.

While the preferred embodiments of the present invention have been shown and described, it is to be understood that various changes and modifications may be made without departing from the scope of the invention as set forth in the claims.

What is claimed is:

1. A print wire driver comprising:

a first yoke having first and second yoke ends spaced apart at a first predetermined distance;

a second yoke having third and fourth yoke ends spaced apart at said first predetermined distance, said second yoke being disposed adjacent said first yoke at a second predetermined distance therefrom, said first yoke end opposing said third yoke end and said second yoke end opposing said fourth yoke end;

a permanent magnet for magnetizing said first yoke with a first magnetic polarity and said second yoke with a second magnetic polarity opposite said first magnetic polarity; and an armature constrained between the yoke ends of said first and second yokes for free movement therebetween without a pivot, said armature having first and second ends;

said armature being movable between an off position contacting said first and fourth yoke ends to form a first magnetic circuit and a print position contacting said second and third yoke ends to form a second magnetic circuit;

said first magnetic circuit forming a path connecting said first yoke end, said armature, said fourth yoke end and said magnet;

said second magnetic circuit forming a path connecting said second yoke end, said armature, said third yoke end and said magnet;

a solenoid disposed between said first and second yokes and surrounding said armature; and a print wire operatively coupled to one of said armature ends;

whereby said armature may be reciprocated between said off position and said print position by alternate excitation of said solenoid.

2. A driver according to claim 1 in which said solenoids are radially arranged so as to concentrate print wires in a central portion.

3. A driver according to claim 1 in which said solenoids are parallely arranged on a straight line perpendicular to a line found between said first and second armature ends.

4. A driver according to claim 1 in which said print wire is secured to the end portion of the armature.

5. A driver according to claim 1 in which said print wire is resiliently biased by spring means.

6. A driver according to claim 1 in which each of said yoke ends is formed into a projection having a width nearly equal to the width of the armature.

7. A driver according to claim 6 in which said armature has a body portion adjacent said yoke ends, which has a greater sectional area than that of the end portion operatively coupled to said print wire.

8. A driver according to claim 6 in which said armature comprises a body portion made of magnetic material adjacent said projected yoke ends and an end portion made of non-magnetic material.

9. A driver according to claim 6 in which said print wire has a smaller effective moving mass than that of the armature.

10. The driver of claim 1 wherein said driver is for use in dot matrix impact printers.

11. The driver of claim 1 further comprising:

means for exciting said solenoid to alternatively magnetically polarize said armature.

* * * * *